US005252129A

United States Patent [19]

Cheng

[11] Patent Number: 5,252,129

[45] Date of Patent: Oct. 12, 1993

[54] METHOD OF MAKING A PAPER DECORATION

[76] Inventor: Peter S. C. Cheng, 5 Ross St., Toronto, Ontario, Canada, M5T 1Z8

[21] Appl. No.: 875,248

[22] Filed: Apr. 28, 1992

[51] Int. Cl.[5] ..... D21J 7/00

[52] U.S. Cl. ..... 162/231; 162/228; 428/24; 428/26; 156/61

[58] Field of Search ..... 162/218, 231, 219, 221, 162/223, 228, 230; 493/955, 956; 264/86, 87, 112; 428/24, 25, 26, 61; 156/62.2, 62.8, 242, 245, 196, 212, 214

[56] References Cited

U.S. PATENT DOCUMENTS

| | | | |
|---|---|---|---|
| 178,379 | 6/1876 | Penley | 428/24 |
| 734,928 | 7/1903 | McEwan | 162/231 |
| 867,389 | 10/1907 | Lorenz | 162/219 |
| 943,796 | 12/1909 | Shogran | 493/956 |
| 1,562,807 | 11/1925 | Thiel | 428/26 |
| 1,580,399 | 4/1926 | Berger | 428/26 |
| 1,717,775 | 6/1929 | Hawley | 162/219 |
| 1,886,429 | 11/1932 | Saeks | 428/26 |
| 1,918,782 | 7/1933 | Randall | 162/219 |
| 2,159,638 | 5/1939 | Schur | 162/135 |
| 2,261,653 | 11/1941 | Lewis | 428/26 |
| 2,552,274 | 5/1951 | Gentile | 156/61 |
| 2,962,762 | 12/1960 | Hartmann | 264/87 |
| 3,017,304 | 1/1962 | Burgeni | 264/112 |
| 3,070,485 | 12/1962 | Strickman | 264/86 |
| 3,533,906 | 10/1970 | Reininger | 162/225 |
| 4,148,857 | 4/1979 | Wheeler | 162/225 |
| 4,994,148 | 2/1991 | Shetka | 162/231 |
| 5,039,465 | 8/1991 | Freeman et al. | 264/86 |

FOREIGN PATENT DOCUMENTS

| | | | |
|---|---|---|---|
| 381378 | 10/1932 | United Kingdom | 162/218 |
| 197805 | 5/1978 | United Kingdom | 162/228 |

*Primary Examiner*—W. Gary Jones
*Assistant Examiner*—Brenda Lamb
*Attorney, Agent, or Firm*—Kirschstein et al.

[57] ABSTRACT

A paper decoration is made by immersing a perforated mold having a predetermined shape into a liquid pool containing paper-making ingredients. A layer of the ingredients deposited on the mold is then dried in situ, after which, the dried paper layer is detached and formed into the paper decoration.

11 Claims, 1 Drawing Sheet

METHOD OF MAKING A PAPER DECORATION

BACKGROUND OF THE INVENTION

1. Field of the Invention

This invention generally relates to a method of making a paper decoration and, more particularly, to making an artificial paper flower.

2. Description of Related Art

The traditional technique of making a paper flower begins with a pre-formed, flat paper sheet. The flat paper sheet is then cut to form the petals, folded or otherwise shaped to form concave or convex configurations typically by the application of heat and/or pressure, and colored to provide multi-colored regions for the flower. The flat paper sheet, however, represents a limiting design factor in the paper-flower-making process because it restricts the flowers so produced to certain shapes and styles when it would be desirable to expand the number of shapes and styles available for decorative purposes.

SUMMARY OF THE INVENTION

1. Objects of the Invention

It is a general object of this invention to advance the state of the art of making and designing paper decorations, particularly flowers.

It is another object of this invention to increase the number of shapes and styles available for artificial paper flowers.

Another object of this invention is to provide a novel method of making a paper flower without starting with a flat paper sheet that is pre-formed.

2. Features of the Invention

In keeping with these objects and others which will become apparent hereinafter, one feature of this invention resides, briefly stated, in a method of making a paper decoration, especially a flower, which method comprises the step of shaping a perforated mold with a predetermined shape. Advantageously, the mold is constituted of a wire mesh material, and may be configured with any desired shape, e.g. a bell or flat shape.

The perforated mold is then immersed into a liquid pool containing water and such paper-making ingredients as wood pulp, re-cycled paper fibers, binders, water-soluble glues, etc. Coloring agents such as dyes can be added to the pool.

The mold is thereupon removed from the pool. This causes the paper-making ingredients to be deposited on the mold. The water drains through the perforations of the mold. The immersion of the mold into, and the removal of the mold from, the pool is repeated a number of times until a relatively thick layer of the deposited paper-making ingredients exists on the mold.

The deposited ingredients are then dried in situ on the mold to form a dried paper layer having the same predetermined shape as the mold. The drying may be performed by allowing the deposited ingredients to air-dry on the mold, or the mold with the deposited ingredients thereon may be heated, e.g. in an oven.

The dried paper layer is thereupon detached, e.g. by peeling, from the mold. The dried paper layer is then formed into the paper decoration. In a preferred embodiment, the dried paper layer is cut into a rosette flower shape having petals emanating symmetrically from a center of the dried paper layer. One or more of the rosette flower shapes may then be mounted on an elongated stem to complete the artificial flower.

Graphic material may be positioned on the mold prior to the drying step. The graphic material may be positioned either prior to the immersing step, or after the immersing step has been completed. Advantageously, the graphic material constitutes a thin, flexible material of paper or fabric on which a message or design appears. The material itself may be pre-cut into a desired shape, e.g. a heart shape in connection with a message referring to St. Valentine's Day.

In accordance with this invention, the paper decoration may be formed without starting from a flat paper sheet, but by initially forming the paper with the shape of the mold itself. There is virtually no limit to the shape of the mold and, hence, no limit to the shape to be imparted to the paper decoration.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
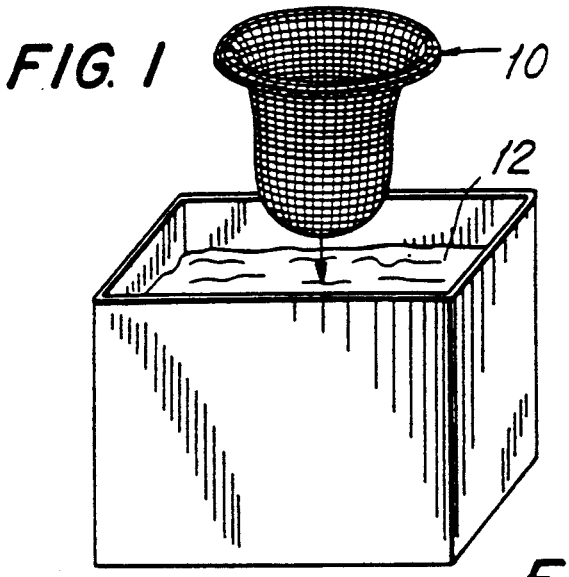
FIG. 1 is a perspective view of a perforated mold for immersion into a pool at one stage of the method according to this invention.

Referring now to the drawings, reference numeral 10 in FIG. 1 generally identifies a perforated mold advantageously constituted of a wire mesh or screen sieve material. Mold 10 is configured with a bell shape. Other shapes for the mold are, of course, comprehended by this invention (see FIG. 7).

Figure 2:
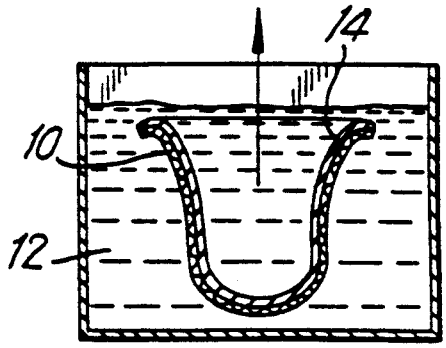
FIG. 2 is a sectional view of the mold immersed in the pool prior to removal.

Mold 10 is immersed, as shown in FIG. 2, into a pool 12 containing water and paper-making ingredients, e.g. wood pulp, re-cycled paper fibers, binders, dyes, water-soluble glues, etc. After immersion, mold 10 is removed from the pool. A thin layer 14 of the paper-making ingredients having a jelly-like consistency is deposited on, and conforms to, the outer peripheral surface of the mold. The immersion and removal steps are repeated a plurality of times until the jelly-like layer 14 has the requisite thickness. The water scooped up from the pool drains through the perforations in the mold.

Figure 3:
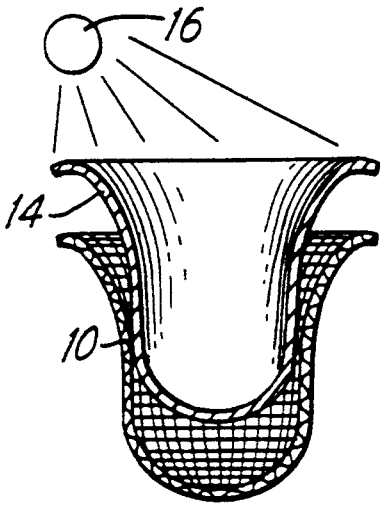
FIG. 3 is a partly-diagrammatic, sectional view depicting the drying of a paper layer in situ on the mold, and the subsequent detachment of the dried paper layer from the mold.

The jelly-like paper layer 14 is then dried, as shown in FIG. 3, in situ on the mold, either by air-drying or by exposure to a source 16 of heat, e.g. in a drying oven. The dried paper layer 14, now having a thickness about 20%–25% of the original thickness that it had before being dried, is detached, e.g. by peeling from the mold, as also depicted in FIG. 3.

Figure 5:
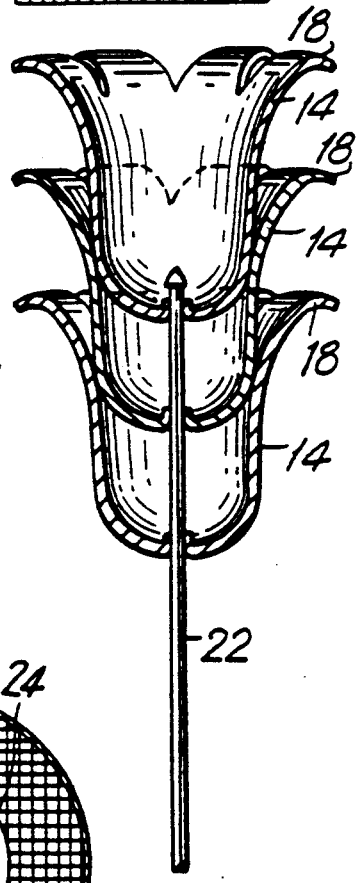
FIG. 5 is a side elevational view of multiple flower shapes mounted on an elongated stem to form an artificial flower.
Figure 4:
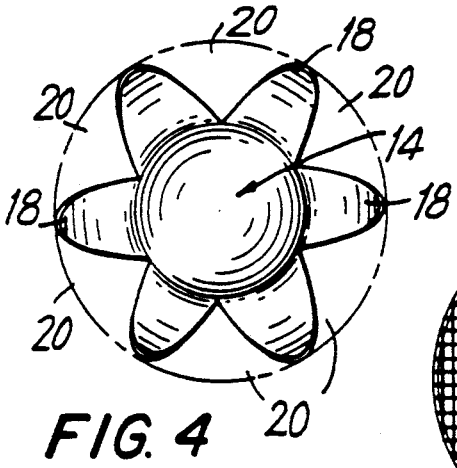
FIG. 4 is a top plan view of the detached paper layer during a cutting stage to form a flower shape.
Figure 6:
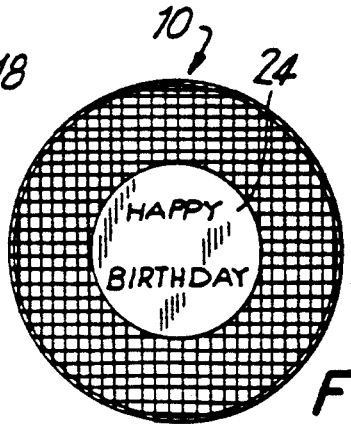
FIG. 6 is a top plan view of the mold of FIG. 1 with graphic material positioned thereon prior to immersion in the pool.

The dried paper layer 14 is next formed into a flower decoration. As shown in FIG. 4, the layer 14 is cut, according to a preferred embodiment, into a rosette flower shape having petals 18 emanating radially and symmetrically from a center of the layer 14. The layer 14 is preferably cut in a die press. The areas 20 depicted in FIG. 4 are discarded as waste, or preferably may be shredded into fibers and re-cycled for use in the pool 12. One or more of the rosette shapes may be mounted, as shown in FIG. 5, on an elongated stem 22 to complete the artificial flower. If multiple rosette shapes are used, then the petals 18 on each rosette shape are angularly offset from the petals of another rosette shape.

In a modification, graphic material 24, such as a pre-cut flexible sheet of paper or fabric having a design or message thereon, is integrally incorporated within the dried paper layer 14. The graphic material 24 may be positioned on the mold before the initial immersion, or may be positioned on the jelly-like paper layer during or after its formation. The weight of the graphic material 24 causes it to sink into the jelly-like layer so that, after the layer 14 has been dried, the graphic material 24 is embedded and sandwiched within the dried layer 14. Any appropriate message or design, preferably with a common theme, may be employed for the graphic material 24.

The method may include immersing the mold in a plurality of pools, each having different coloring agents therein to achieve a multi-colored decoration.

Figure 7:
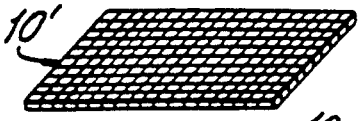
FIG. 7 is a perspective view of a flat, perforated mold according to this invention.

As shown in FIG. 7, a flat, two-dimensional, perforated mold 10' may be immersed into the pool 12, and the method described above repeated. Any two- or three-dimensional shape can be used for the mold.

It will be understood that each of the elements described above, or two or more together, also may find a useful application in other types of constructions differing from the types described above.

While the invention has been illustrated and described as embodied in a method of making a paper decoration, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A method of making a paper decoration, comprising the successively performed steps of:

(a) shaping a perforated mold with a predetermined shape;

(b) positioning a sheet of graphic material on the mold;

(c) immersing the perforated mold and the sheet into a liquid pool containing paper fibers;

(d) removing the mold and the sheet from the pool to deposit the paper fibers on the mold and the sheet;

(e) drying the deposited fibers in situ on the mold to form a dried paper layer having said predetermined shape with the sheet integrated therein;

(f) detaching the dried paper layer and the integrated sheet from the mold; and (g) forming the dried paper layer and the integrated sheet into the paper decoration.

2. The method according to claim 1, wherein the shaping step is performed by providing a wire mesh, and configuring the wire mesh with a three-dimensional shape.

3. The method according to claim 1, wherein the paper fibers are wood pulp. .

4. The method according to claim 3, wherein the paper fibers are re-cycled paper fibers.

5. The method according to claim 3, wherein the pool also contains binders and glue.

6. The method according to claim 3, wherein the pool also contains coloring dyes.

7. The method according to claim 1, wherein the immersing and removing steps are performed for a plurality of times before performing the drying step.

8. The method according to claim 1, wherein the drying step is performed by allowing the deposited ingredients to air-dry in situ on the mold.

9. The method according to claim 1, wherein the drying step is performed by heating the deposited materials in situ on the mold.

10. The method according to claim 1, wherein the drying step is performed by heating the mold.

11. The method according to claim 1, wherein the forming step is performed by cutting the dried paper layer into a rosette flower shape having petals emanating radially from a center of the dried paper layer, and wherein the mounting step includes mounting a plurality of the rosette flower shapes on a stem.

* * * * *